US006958570B2

(12) United States Patent
Kijima et al.

(10) Patent No.: US 6,958,570 B2
(45) Date of Patent: Oct. 25, 2005

(54) DISPLAY DEVICE

(75) Inventors: Yuuichi Kijima, Chosei (JP); Yoshiyuki Kaneko, Hachioji (JP); Shigemi Hirasawa, Chiba (JP); Susumu Sasaki, Chiba (JP); Tomoki Nakamura, Mobara (JP); Hiroshi Kawasaki, Ooamishirasato (JP); Jun Ishikawa, Mobara (JP)

(73) Assignees: Hitachi Displays, LTD, Mobara (JP); Hitachi Device Engineering Co., Ltd., Mobara (JP)

( * ) Notice: Subject to any disclaimer, the term of this patent is extended or adjusted under 35 U.S.C. 154(b) by 181 days.

(21) Appl. No.: 10/443,100

(22) Filed: May 22, 2003

(65) Prior Publication Data

US 2005/0110389 A1 May 26, 2005

(30) Foreign Application Priority Data

May 22, 2002 (JP) ..... 2002-148101

(51) Int. Cl.[7] ..... H01J 9/38; H01J 29/94; H01J 31/12

(52) U.S. Cl. ..... 313/292; 313/497; 313/561; 313/610; 313/634; 313/254; 313/261; 313/286

(58) Field of Search ..... 313/495–497, 313/561, 553, 573, 581, 584, 585, 609, 610, 634, 292, 252–254, 257, 261, 284, 286, 288

(56) References Cited

U.S. PATENT DOCUMENTS

| | | | | | |
|---|---|---|---|---|---|
| 5,821,689 | A | * | 10/1998 | Andoh et al. | 313/495 |
| 6,515,415 | B1 | * | 2/2003 | Han et al. | 313/496 |
| 6,768,255 | B1 | * | 7/2004 | Na | 313/495 |
| 2004/0104655 | A1 | * | 6/2004 | Kodera et al. | 313/292 |

* cited by examiner

*Primary Examiner*—Ashok Patel
(74) *Attorney, Agent, or Firm*—Antonelli, Terry, Stout and Kraus, LLP

(57) ABSTRACT

Inside an outer frame, which is interposed at between opposedly facing peripheries between a back substrate and a front substrate, there is an inner frame which fixes both end portions of plate member control electrodes, which are constituted of a large number of parallel strip-like electrode elements. By integrally forming the plate member control electrodes such that the plate member control electrodes are fixed to both end portions of a display region, a single part is formed. Further, a getter chamber is formed between the outer frame and the inner frame and getters are accommodated in the getter chamber. Due to such a constitution, the operability and yield rate of products at the time of assembling can be enhanced. Further, it is possible to hold a desired degree of vacuum in the space between the substrates for a long time.

17 Claims, 13 Drawing Sheets

FIG. 3B
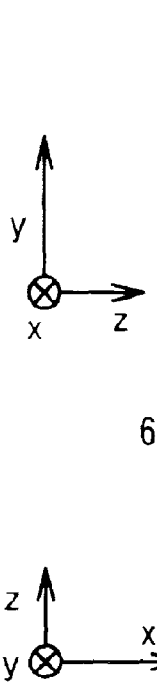
FIG. 3A
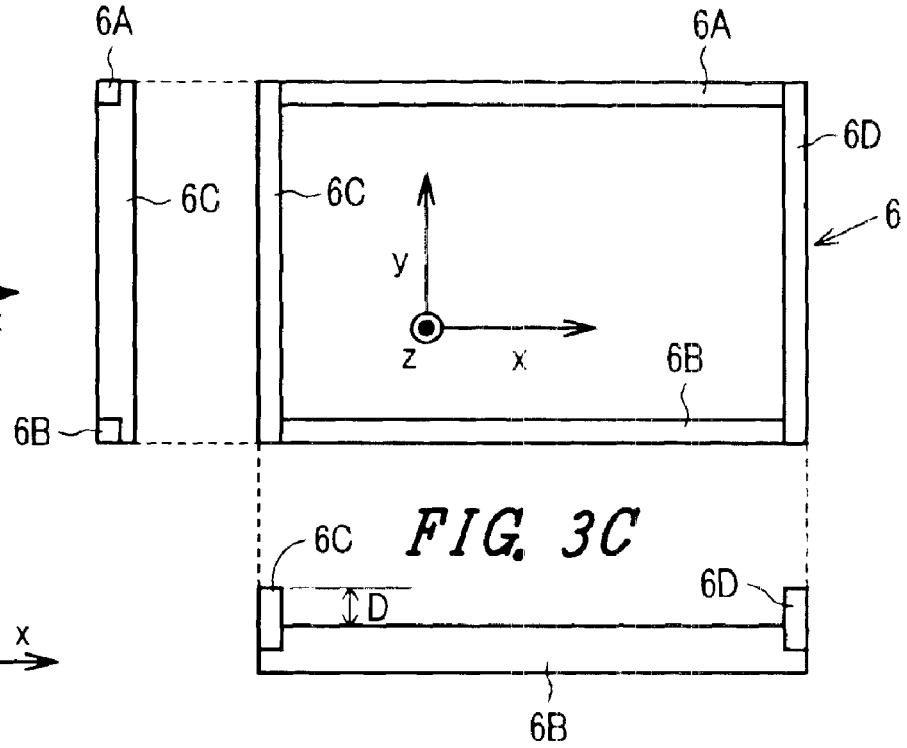
FIG. 3C
FIG. 4
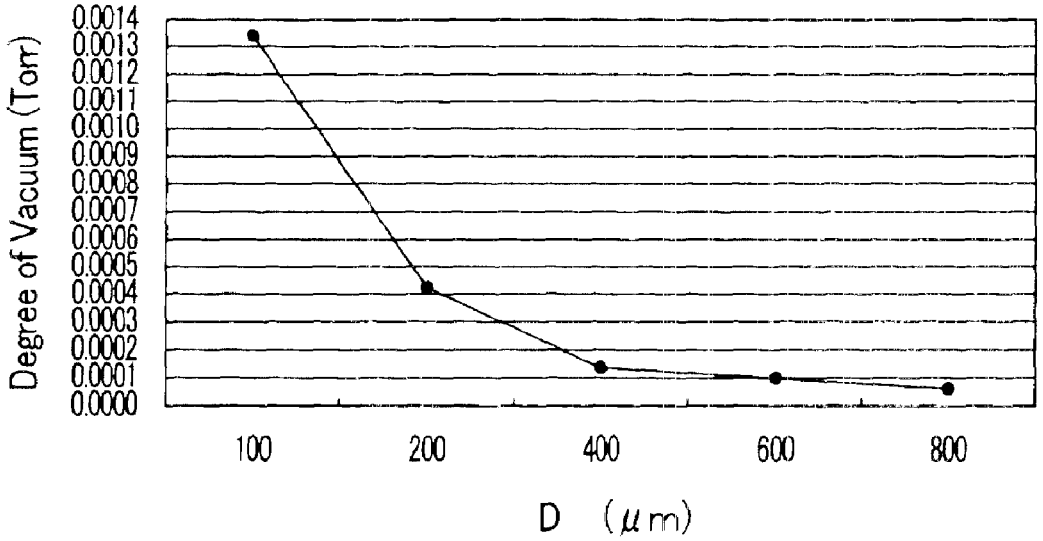

DISPLAY DEVICE

BACKGROUND OF THE INVENTION

The present invention relates to a display device of the type that utilizes an emission of electrons into a vacuum space which is defined between a face substrate and a back substrate; and, more particularly, the invention relates to a display device in which cathode lines are arranged with high accuracy, which cathode lines have electron sources and control electrodes which control the quantity of electrons drawn out or emitted from the electron sources, and the display device can exhibit stable display characteristics and maintains a vacuum between the front substrate and the back substrate for a long time.

As a display device which exhibits high brightness and high definition, color cathode ray tubes have been widely used conventionally. However, along with the recent demand for the generation of higher quality images in information processing equipment or television broadcasting, the demand for planar displays (panel displays), which are light in weight and require a small space, while exhibiting high brightness and high definition, has been increasing.

As typical examples, liquid crystal display devices, plasma display devices and the like have been put into practical use. Further, as display devices which can realize a higher brightness, it is expected that various kinds of panel-type display devices, including a display device which utilizes an emission of electrons from electron emitting sources into a vacuum (hereinafter, referred to as "an electron emission type display device" or "a field emission type display device") and an organic EL display device which is characterized by low power consumption, will be commercialized.

Among panel type display devices, such as the above-mentioned field emission type display device, a display device having an electron emission structure, which was introduced by C. A. Spindt et al, a display device having an electron emission structure of a metal-insulator-metal (MIM) type, a display device having an electron emission structure which utilizes an electron emission phenomenon based on a quantum theory tunneling effect (also referred to as a "surface conduction type electron emitting source"), and a display device which utilizes an electron emission phenomenon having a diamond film, a graphite film and carbon nanotubes and the like are known.

A field emission type display device includes a back substrate, which has cathode lines including electron-emission-type electron sources and control electrodes formed on an inner surface thereof, and a front substrate, which has an anode and a fluorescent material formed on an inner surface which faces the back substrate. Both substrates are laminated to each other with a sealing frame being inserted between the inner peripheries of both substrates, and the inside space thereof is evacuated. Further, to set a gap between the back substrate and the front substrate to a given value, gap holding members are provided between the back substrate and the front substrate.

SUMMARY OF THE INVENTION

FIG. 17 is a plan view of a back substrate of a field emission type display device. FIG. 17 is a schematic view as viewed from a front substrate side (not shown in the drawing). Here, with respect to the structure which will be explained in conjunction with FIG. 17, the technology relevant to the provision of plate member control electrodes constituted by a large number of parallel strip-like electrode elements represents subject matter which the inventors of the present invention have developed in the course of arriving at the present invention, and, hence, this technology does not constitute previously known subject matter. The back substrate 1 is configured such that, on an insulation substrate, which is preferably made of glass, alumina or the like, a plurality of cathode lines 2, having electron sources, and plate member control electrodes 4, constituted of a plurality of strip-like electrode elements, are formed. The cathode lines 2 extend in a first direction on the back substrate 1 and are arranged in parallel in a second direction which crosses the first direction. The cathode lines 2 are patterned by printing a conductive paste containing silver or the like In lines which extend in the above-mentioned first direction, and they are arranged in parallel in the above-mentioned second direction. End portions of the cathode lines 2 are extended out to the outside of a sealing frame 90 to serve as cathode line lead lines 20.

The plate member control electrodes 4 shown in FIG. 17 are manufactured as separate members. Close to and above the cathode lines 2 having the electron sources (front substrate side), respective strip-like electrode elements, which constitute the plate member control electrodes 4, extend in the above-mentioned second direction and are arranged in parallel in the above-mentioned first direction. The plate member control electrodes 4 are fixed to the back substrate 1 by press members 60 or the like, which are formed of an insulation body made of glass material and are arranged at a fixing portion which is located outside a display region AR. In the vicinity of the fixing portion, or in the vicinity of the sealing frame 90, lead lines (plate member control electrode lead lines) 40 are connected to the plate member control electrodes 4, and the lead lines 40 extend out to the outer periphery of the display device. Pixels are formed at crossing portions where the cathode lines (electron sources provided to cathode lines) 2 and the plate member control electrodes 4 cross each other. Here, the sealing frame 90 may perform the function of the press members 60.

In response to a potential difference between the cathode lines 2 and the plate member control electrodes 4 (respective strip-like electrode elements constituting the plate member control electrodes 4), an emission quantity (including ON and OFF states) of electrons from the electron sources provided on the cathode lines 2 is controlled. On the other hand, the front substrate (not shown in the drawing) is formed of an insulation material having a light transmissivity, such as glass or the like, and it has an anode and fluorescent materials formed on an inner surface thereof. The fluorescent materials are formed at areas corresponding to the pixels which are formed at the crossing portions between the cathode lines 2 and the plate member control electrodes 4.

The inside space sealed by the sealing frame 90 is evacuated through an exhaust hole 11, so that a vacuum of $10^{-5}$ to $10^{-7}$ Torr is created in the space. Each crossing portion where the plate member control electrode 4 and the cathode line 2 cross each other has an electron passing aperture (not shown in the drawing) and electrons emitted from the electron source of the cathode line 2 are allowed to pass therethrough to the front substrate side (anode side). The above-mentioned electron source is constituted of carbon nanotubes (CNT), diamond-like carbons (DLC), other field emission cathode material or another field emission shape. It is necessary to arrange the plate member control electrodes 4 on the back substrate 1, on which the cathode lines 2 are formed, wherein the plate member control electrodes 4 are formed at a given interval over the whole area of the display region AR with respect to the cathode lines 2.

FIG. 18 is a perspective view schematically illustrating one example of a mounting state of gap holding members which constitute means for maintaining a given gap between the back substrate and the front substrate. In FIG. 18, the same reference symbols as those used in FIG. 17 indicate identical functional parts. In this example, insulation plate members made of glass or the like, which are inserted between the back substrate 1 and the front substrate 21, constitute gap holding members 10.

Here, in the drawing, x indicates the extending direction of the plate member control electrodes 4 in FIG. 17, y indicates the extending direction of the cathode lines 2 in FIG. 17, and z indicates a direction which crosses the substrate surfaces of the back substrate and the front substrate at a right angle. The gap holding members 10 are arranged in parallel to the extending direction of the cathode lines 2 shown in FIG. 17 and between neighboring cathode lines. Here, positions where the gap holding members 10 are formed need not always be arranged among all cathode lines; rather, these positions may be arranged every other plurality of cathode lines. The plate member control electrodes 4 are formed of, for example, a large number of aluminum-based or iron-based strip-like thin plates. It is preferable to form a large number of electron passing apertures in each thin plate by etching using a photolithography technique.

After forming the cathode lines 2 on the back substrate, the plate member control electrodes 4 are formed. The plate member control electrodes 4 are formed by etching a thin plate (for example, having a thickness of approximately 0.05 mm), and the plate member control electrodes 4 are fixed by an electron passing aperture forming region that is formed on the display region AR, the press members 60 or the sealing frame 90. Thereafter, the front substrate is laminated to the back substrate 1 and is fixed to the back substrate 1 and the sealing frame 90 using frit glass or the like; and, thereafter, a vacuum state is created in the inside space of the display region AR surrounded by the sealing frame 90 by evacuating air from the inside space of the display region AR through the exhaust hole 11.

However, as mentioned previously, since the plate member control electrodes 4 are extremely thin and constitute precision parts, cracks or breakage are liable to occur during transfer of these parts or in a mounting step for fixing the parts to the back substrate. Accordingly, the operability and the yield rate of the products are lowered. Further, also with respect to the product state after assembling, cracks tend to occur in the vicinity of the above-mentioned boundary region by repeated thermal expansions which occur during the operation of the device. Still further, in an extreme case, this gives rise to breakage of the plate member control electrodes 4, thus lowering the reliability of the products.

Further, in the above-mentioned structure, sealing of the display device is performed using only the sealing frame, and evacuation is performed only through discharging of air through the exhaust hole; and, hence, there is a limit to the degree of obtainable vacuum. Further, it is difficult to maintain a desired vacuum for a long time; and, hence, there is possibility that the reliability of the product will be lowered.

Accordingly, it is an object of the present invention to provide a reliable display device which can prevent the occurrence of cracks and breakage at the time of handling plate member control electrodes, can enhance the operability at the time of assembling and the yield rate of the products, and can maintain a desired degree of vacuum for a long time.

To achieve the above-mentioned object, in accordance with the present invention, the display device has the following basic structure. That is, inside an outer frame, which is interposed at opposing peripheries between a back substrate and a front substrate, there is provided an inner frame which surrounds the outer periphery of a display region and fixes both end portions, in the extending direction, of a large number of strip-like electrode elements, which constitute the plate member control electrodes. Further, in accordance with the present invention, the strip-like electrode elements which constitute the plate member control electrodes are integrally fixed to the inner frame to form a single part therewith, thus facilitating handling in an assembling process. Further, a getter chamber is formed between the outer frame and the inner frame, and granular or cylindrical granular getters are accommodated in the getter chamber. Typical constitutions of the display device of the present invention will be described hereinafter. In this specification, in some cases, the strip-like electrode elements are described simply as plate member control electrodes.

(1) A display device includes a front substrate having anodes and fluorescent materials on an inner surface thereof; a back substrate having a plurality of cathode lines which extend in one direction, are arranged in parallel in another direction which crosses the above-mentioned one direction and include electron sources, and plate member control electrodes which are formed by arranging a plurality of strip-like electrode elements which cross the cathode lines in a non-contact state within a display region, extend in the above-mentioned another direction, are arranged in parallel in the above-mentioned one direction and have electron passing holes which allow electrons from the electron sources to pass therethrough to the front substrate side, on an inner surface thereof, the back substrate being arranged to face the front substrate in an opposed manner with a given gap therebetween, and an outer frame for maintaining the given gap which is interposed between the front substrate and the back substrate, which outer frame is disposed around the display region.

The display device further includes an inner frame which is arranged outside the display region and inside the outer frame and which fixes both end regions of the strip-like electrode elements which constitute the plate member control electrodes to the back substrate. A space defined inside the outer frame and between the front substrate and the back substrate is evacuated and is sealed to create a vacuum in the space.

(2) In the above-mentioned constitution (1), with respect to the height of the outer frame and the height of the inner frame in the direction which is orthogonal to the surfaces of the front substrate and the back substrate, the height of at least one portion of the inner frame is set to be lower than the height of the outer frame by an amount corresponding to a gap which is necessary for discharging air to create the vacuum in the space by sealing.

(3) In either one of the above-mentioned constitutions (1) and (2), the inner frame is formed by integrally combining a plurality of members in a frame shape.

(4) In the above-mentioned constitution (3), the plurality of members which constitute the inner frame are constituted of one pair of sides and another pair of sides; and, at end portions of the above-mentioned one pair of sides and the above-mentioned another pair of sides, inclined surfaces are formed which complementarily engage with each other in the direction orthogonal to the front substrate and the back substrate.

(5) A display device includes a front substrate having anodes and fluorescent materials on an inner surface thereof; a back substrate having a plurality of cathode lines which extend in one direction, are arranged in parallel in another direction which crosses the one direction and include electron sources, and plate member control electrodes which cross the cathode lines in a non-contact state within a display region, extend in the above-mentioned another direction, are arranged in parallel in the above-mentioned one direction and have electron passing holes which allow electrons from the electron sources to pass therethrough to the front substrate side, on an inner surface thereof, the back substrate being arranged to face the front substrate in an opposed manner with a given gap therebetween; and an outer frame for maintaining the given gap, which is interposed between the front substrate and the back substrate, which outer frame is disposed around the display region.

The display device further includes an inner frame which is arranged outside the display region and inside the outer frame and fixes both end portions of the plate member control electrodes to the back substrate, and a plurality of gap holding members which are provided within the display region surrounded by the inner frame and hold the gap defined between the front substrate and the back substrate. A space defined inside the outer frame and between the front substrate and the back substrate is evacuated and sealed to create a vacuum in the space.

(6) In the above-mentioned constitution (5), with respect to the height of the outer frame and the height of the inner frame in the direction which is orthogonal to the surfaces of the front substrate and the back substrate, the height of at least one portion of the inner frame is set to be lower than the height of the outer frame by an amount corresponding to a gap which is necessary for discharging air to create the vacuum in the space by sealing.

(7) In either one of the constitutions (5) and (6), grooves which are provided for making the plurality of gap holding members engage with given positions are formed on opposing surfaces of one pair of two parallel sides of the inner frame.

(8) In either one of the constitutions (5) and (6), the plurality of gap holding members are fixed to opposing faces of one pair of two parallel sides of the inner frame using glass frit at the given positions.

(9) In any one of the constitutions (5) to (8), grooves which are provided for positioning the respective strip-like electrode elements of the plate member control electrodes are formed on sides of the inner frame which face the plate member control electrodes formed on the back substrate in an opposed manner.

(10) In any one of the constitutions (5) to (8), frit grass which is provided for fixing the respective strip-like electrode elements of the plate member control electrodes to given positions are formed on sides of the inner frame which face the plate member control electrodes that are formed on the back substrate in an opposed manner.

(11) In any one of the constitutions (5) to (10), grooves which are provided for positioning the respective strip-like electrode elements of the plate member control electrodes are formed on sides of the gap holding members which face the plate member control electrodes that are formed on the back substrate in an opposed manner.

(12) In anyone of the constitutions (5) to (11), pressing plates which sandwich and fix the plate member control electrodes together with the inner frame are formed on the back substrate.

(13) In the constitution (12), grooves which are provided for accommodating the pressing plates are formed on the back substrate.

(14) A display device includes a front substrate having anodes and fluorescent materials on an inner surface thereof; a back substrate having a plurality of cathode lines which extend in one direction, are arranged in parallel in another direction which crosses the one direction and include electron sources, and a plurality of control electrodes which cross the cathode lines in a non-contact state within a display region, extend in the above-mentioned another direction, are arranged in parallel in the above-mentioned one direction and allow electrons from the electron sources to pass therethrough to the front substrate side, on an inner surface thereof, the back substrate being arranged to face the front substrate in an opposed manner with a given gap therebetween; and an outer frame for maintaining the given gap, which is interposed between the front substrate and the back substrate, the outer frame being disposed around the display region.

The display device further includes an inner frame which is arranged outside the display region and inside the outer frame, and a getter chamber which is defined between the outer frame and the inner frame. A space defined inside the outer frame and between the front substrate and the back substrate is evacuated and sealed to create a vacuum in the space.

(15) In the constitution (14), projection members which are provided for positioning the inner frame at a given position and which also suppress the movement of getters are formed between the inner frame and the outer frame.

(16) In either one of constitutions (14) and (15), an adhesive is provided to the getter chamber for fixing the getters.

Due to the respective constitutions of the present invention which are enumerated above, handling of the plate member control electrodes which are constituted of strip-like electrode elements in an assembling step is facilitated, the occurrence of cracks and breakage of the strip-like electrode elements in the assembling step can be prevented, and the operability and yield rate of the products are enhanced. Further, it is possible to hold a desired degree of vacuum for a long time.

It is needless to say that the present invention is not limited to the above-mentioned constitutions, and the constitutions of embodiments to be described later and various modifications can be made without departing from the technical concept of the present invention.

BRIEF DESCRIPTION OF THE DRAWINGS

FIGS. 3A, 3B and 3C are a plan view and respective side views of an example of an inner frame according to the embodiment of the present invention.

FIG. 4 is graph showing the difference D between the height of a long-side member and a short-side member of the inner frame and an experimental result of the ultimate vacuum obtained in an exhaust step.

FIGS. 5A and 5B are diagrams showing one example of the shape and size of a getter, wherein FIG. 5A is an end view and FIG. 5B is a side view.

FIGS. 6A and 6B are diagrams showing another example of one of the sides of the inner frame at the gap holding member mounting side, wherein FIG. 6A is a plan view and FIG. 6B is a side view.

FIG. 10A and FIG. 10B show an example in which the inner frame, the plate member control electrodes and gap holding members are integrally formed into one control electrode part, wherein FIG. 10A is a plan view and FIG. 10B is a sectional view taken along line B–B' in FIG. 10A.

DESCRIPTION OF THE PREFERRED EMBODIMENTS

Figure 1:
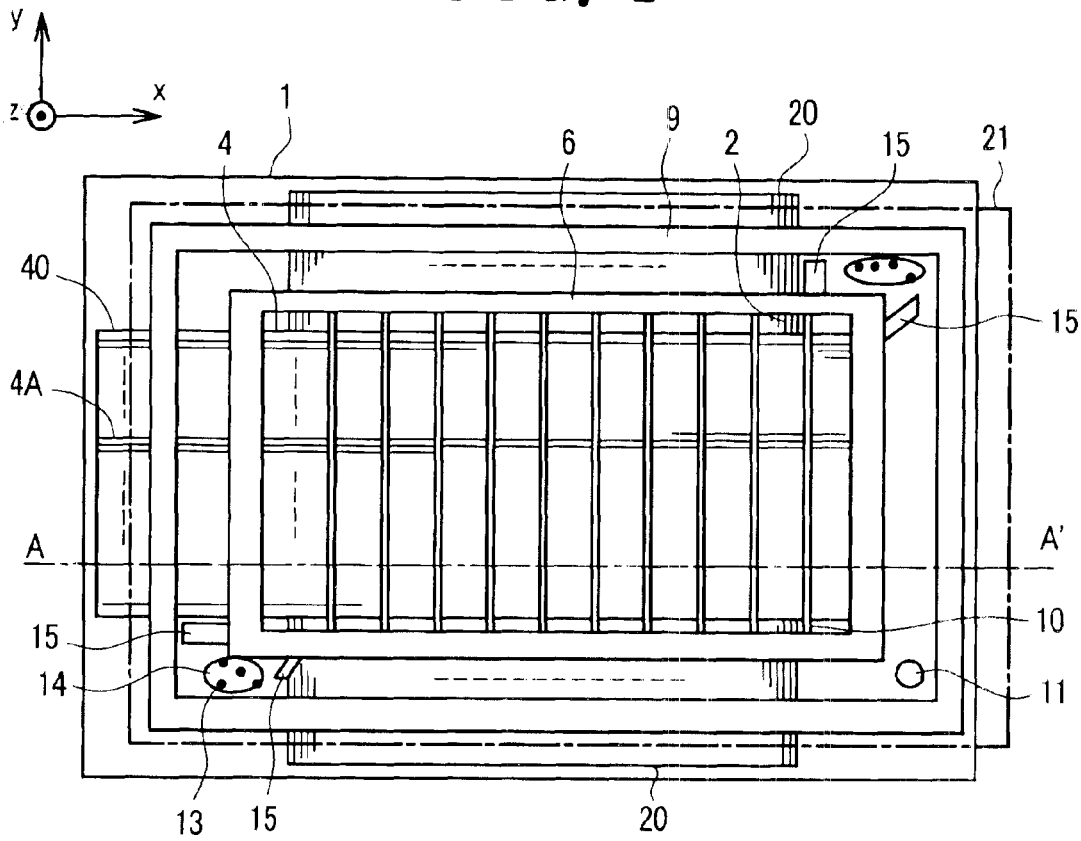
FIG. 1 is a plan view schematically illustrating the back panel side of one embodiment of a display device according to the present invention.

Preferred embodiments of the present invention will be explained in detail hereinafter in conjunction with the drawings. FIG. 1 is a plan view showing a back panel side of one embodiment of a display device according to the present invention. Here, FIG. 1 is a plan view as seen from a front substrate side, which is indicated by an imaginary line 21. In FIG. 1, numeral 1 indicates a back substrate, numeral 2 indicates cathode lines, numeral 20 indicates cathode line lead lines, numeral 4 indicates plate member control electrodes, numeral 4A indicates strip-like electrode elements which constitute the plate member control electrodes, numeral 40 indicates plate member control electrode lead lines, numeral 6 Indicates an inner frame, numeral 9 indicates an outer frame, numeral 10 indicates gap holding members, numeral 11 indicates an exhaust hole, numeral 13 indicates getters, numeral 14 indicates an adhesive, numeral 15 indicates guide members, and numeral 21 indicates a front substrate.

Figure 2:
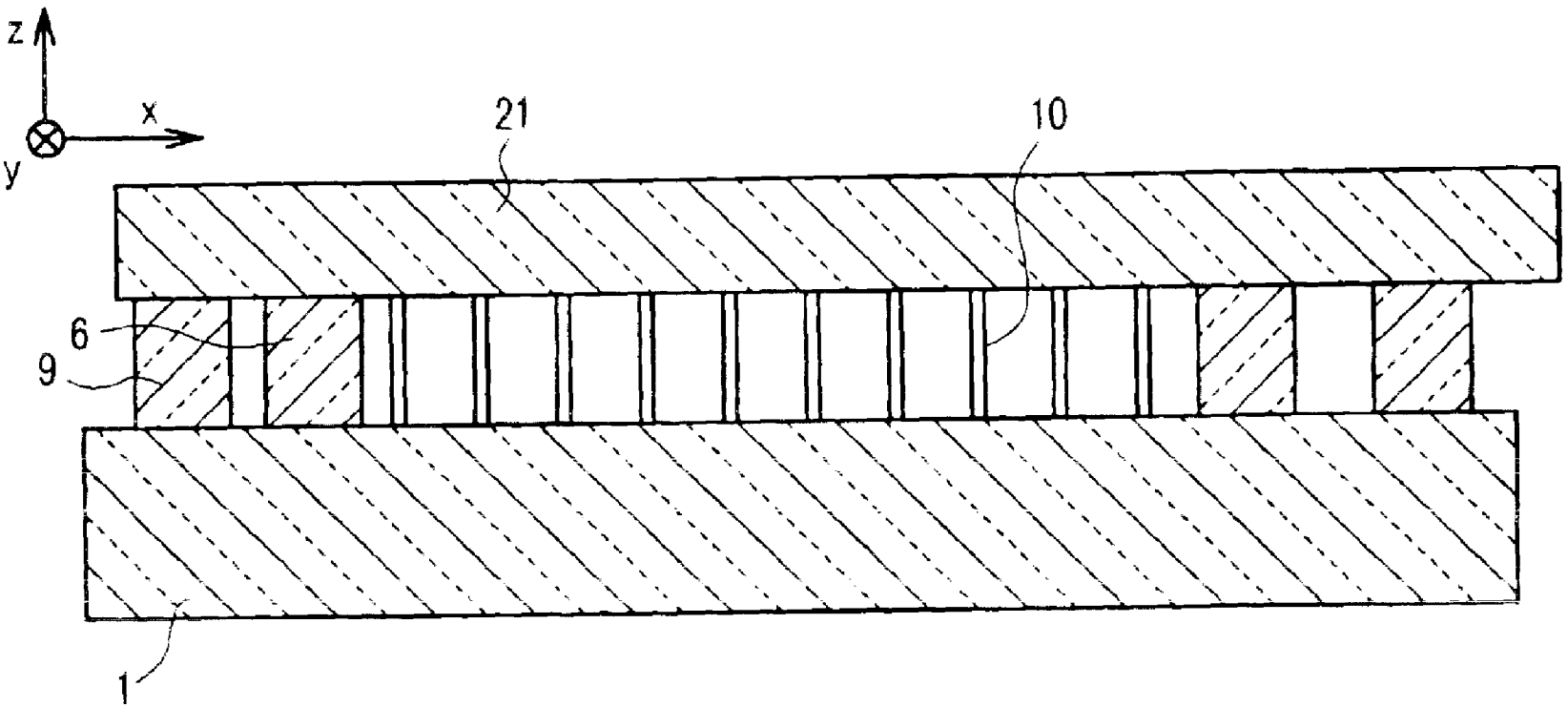
FIG. 2 is a cross-sectional view taken along a line A—A' in FIG. 1.

FIG. 2 is a cross sectional view taken along a line A–A$^T$ in FIG. 1. Here, FIG. 2 shows only the relationship of the back substrate 1, the front substrate 21, the inner frame 6, the outer frame 9 and the gap holding members 10; and, hence, the illustration of the cathode lines 2, the plate member control electrodes 4 and other detailed parts in FIG. 1 is omitted.

In FIG. 1 and FIG. 2, on an inner surface of the back substrate 1, a plurality of cathode lines 2, which extend in a first direction (y direction), are arranged in parallel in a second direction(x direction) which crosses the above-mentioned first direction and include electron sources (not shown in the drawing), are formed by printing with a conductive material, such as silver paste or the like. A display region is formed inside the inner frame 6, and the outer frame 9 is mounted around an outer periphery of the inner frame 6. On the display region inside the inner frame 6 and above the cathode lines 2, the plate member control electrodes 4, which are formed as a plurality of strip-like electrode elements 4A that cross the cathode lines 2 in anon-contact manner, extend in the x direction and are arranged in parallel in they direction, and electron passing apertures are provided therein which allow electrons emitted from the electron sources provided on the cathode lines to pass therethrough to the front substrate 21 side.

The plate member control electrode 4 is formed of iron-based stainless steal material or iron material, and the plate thickness thereof is approximately 0.025 mm to 0.150 mm, for example. In portions of each strip-like electrode element 4A which face the above-mentioned electron sources, one or a plurality of electron beam passing apertures (not shown in the drawing) are formed. The plate member control electrodes 4, which are constituted of a strip-like electrode element 4A, have the end portions thereof fixed to the inner frame 6. In this embodiment, one end (right side in FIG. 1) of the plate member control electrode 4 is arranged below the inner frame 6, or in the vicinity of positions below the inner frame 6; while, the other end (left side in FIG. 1) is fixed to the inner frame 6, and, at the same time, it extends in the direction toward the outer frame 9 from the inner frame 6 and is connected to a plate member control electrode lead line 40. The plate member control electrode lead lines 40 are extended out to end portions of the back substrate 1.

A gap defined between the inner frame 6 and the outer frame 9 forms a getter chamber, and getters 13 are accommodated in portions of the getter chamber. In this embodiment, a pair of guide members 15, which position the inner frame 6, are provided in the gap defined between the inner frame 6 and the outer frame 9, and the inner frame 6 is positioned by these guide members 15. Although these guide members 15 are arranged in pairs at diagonal portions of the inner frame 6 which face each other in an opposed manner, the guide members 15 may be provided at all diagonal portions. Further, although the guide members 15 are constituted by fixing independent glass materials to the back substrate 1, the guide members 15 may be formed as portions of the outer frame 9 or portions of the inner frame 6.

To the inner frame 6, the gap holding members 10 are provided, which extend in the y direction and have the portions thereof fixed to two parallel sides of the inner frame 6. These gap holding members 10 are preferably formed of a glass plate and maintain a given gap between the back substrate 1 and the front substrate 21, which is defined by the outer frame 9 (or the inner frame 6).

In this embodiment, these guide members 15 serve as movement restriction members for the getters 13. Further, in this embodiment, a structure in which the getters 13 are fixed using the adhesive 14 filled between a pair of guide members 15 is adopted. It is also possible to use a tacky adhesive in place of the standard adhesive. Here, to the back substrate 1 on which the constituent members, such as the cathode lines 2, the plate member control electrodes 4 fixed to the inner frame 6, the outer frame 9 and the like, are mounted, the front substrate 21 is fixed in an overlapped manner. It is preferable to insert an adhesive, such as frit glass or the like, into joining portions of the back substrate 1, the outer frame 9, the inner frame 6 and the front substrate 21. Then, it is preferable to insert the getters 13 through the exhaust hole 11 and to move and arrange the getters 13 at the adhesive applied positions. Accordingly, between the guide member 15 and the outer frame 9 (or the inner frame 6), a gap of a level which enables the movement of getters 13 is formed.

FIG. 3A, FIG. 3B and FIG. 3C are views showing an example of the inner frame 6 according to one embodiment of the present invention, wherein FIG. 3A is a plan view, FIG. 3B is a side view at the side to which the plate member control electrodes are fixed, and FIG. 3C is a side view of the side to which the gap holding members are fixed. The inner frame 6 has four sides, including a pair of short sides to which the plate member control electrodes are fixed and a pair of long sides which hold these short sides. The inner frame 6 is constituted of a glass plate or a ceramics plate. Although these four sides may be formed into an integral frame shape, in this embodiment, four glass materials consisting of long-side members 6A, 6B and the short-side members 6C, 6D are combined to form a frame shape.

The height of the long-side members 6A, 6B in the direction toward the front substrate 21 (z direction) is set to be slightly less than the height of the short-side members 6C, 6D which fix the plate member control electrodes 4. This difference in height P forms an exhaust passage between the front substrate and the plate member control electrode 4 for use at the time the evacuation the inner space is carried out. As will be explained later in conjunction with FIG. 4, when the difference D is equal to or more than 0.400 mm (400 $\mu$m), there is no practical influence on the exhaust time. Further, it is necessary to set this difference in height D to a value which is equal to or below the size of the getters so as to prevent the intrusion of the getters into the display region inside the inner frame 6.

FIG. 4 is graph showing the results of an experiment which indicate the relationship between the difference in height D between the long-side member and the short-side member of the inner frame and the ultimate degree of vacuum in an exhaust step. FIG. 4 shows a case in which the exhaust of air from the inner space is carried out for three hours (3 h) while changing the above-mentioned difference in height D, wherein the difference in height D ($\mu$m) is taken on the axis of abscissas and the degree of vacuum (Torr) is taken on the axis of ordinates. As shown in FIG. 4, by setting the difference in height D to a value equal to or more than 400 $\mu$m, favorable ultimate vacuum conditions can be obtained. Here, as a typical example, in case the evacuation is carried out for three hours while setting the difference in height P to 100 $\mu$m, 200 $\mu$m, 400 $\mu$m, 600 $\mu$m, and 800 $\mu$m, respectively, when the difference in height P is 100 $\mu$m, the ultimate vacuum is 0.001333 Torr; when the difference in height D is 200 $\mu$m, the ultimate vacuum is 0.000417 Torr; when the difference in height D is 400 $\mu$m, the ultimate vacuum is 0.000133 Torr; when the difference in height D is 600 $\mu$m, the ultimate vacuum is 0.000089 Torr; and when the difference in height P is 800 $\mu$m, the ultimate vacuum is 0.000056 Torr.

Figure 5A:
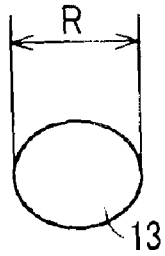
Figure 5B:
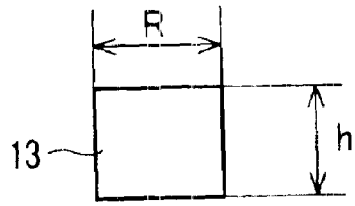

FIG. 5A and FIG. 5B are diagrams showing one example of the shape and the size of the getters 13, wherein FIG. 5A is an upper end view and FIG. 5B is a side view. The getter 13 is formed of a pellet having an approximately cylindrical shape. Assuming that the diameter of an upper end face is R and the height of a side face is h, these dimensions are set to R>D, h>D, with respect to the difference in height D between the long-side member and the short-side member of the above-mentioned inner frames. By setting these sizes in this manner, there is no possibility that the getters 13 intrude on the inside of the inner frame 6. As these getters 13, it is possible to use commercially available products having sizes which are substantially set, such that R=2 mm, h=2 mm, for example.

Zr-based non-volatile type getters are preferably used as these getters 13. After joining the front substrate with the back substrate, the getters 13 are inserted through the exhaust hole 11 (FIG. 1), and they are moved between the guide members 15 and are adhered by the adhesive 14. Thereafter, the exhaust step is executed and the getters 13 are activated at a baking temperature in a baking step so as to increase the degree of vacuum.

Figure 6A:
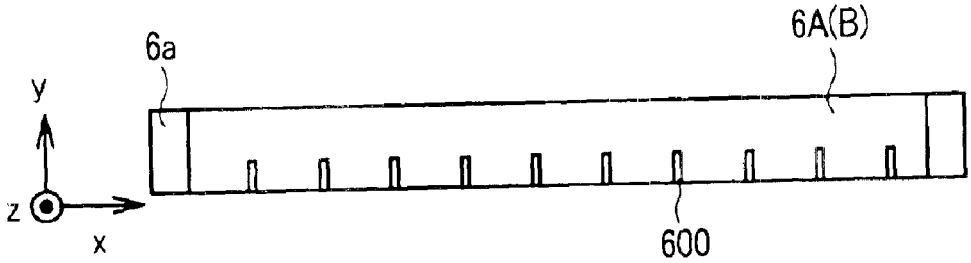
Figure 6B:
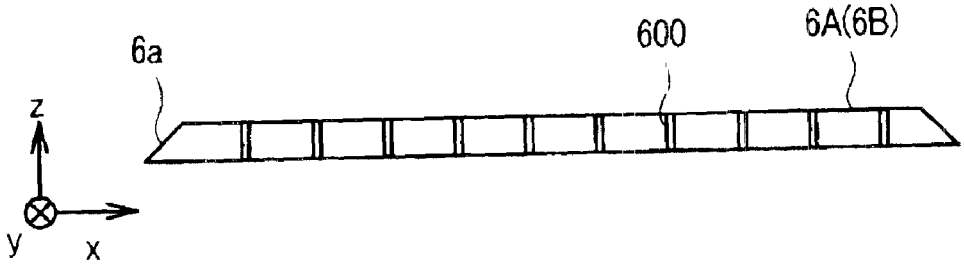

FIG. 6A and FIG. 6B are diagrams showing another example one of a pair of sides of the inner frame on which gap holding members are mounted, wherein FIG. 6A is a plan view and FIG. 6B is a side view. The side 6A(6B) at the gap holding member mounting side constitutes a long side. At a portion of the inner frame 6 which constitutes an inner wall, grooves 600, which hold the gap holding members 10 between such an inner wall and another inner wall, are respectively formed. Inclined surfaces 6*a* are formed on respective end portions of the side 6A (6B). When a glass plate having a thickness of 0.050 mm and a height (z direction) of 3 mm is used as the gap holding member 10, the width of the groove 600 is set to approximately 0.060 to 0.100 mm. Both ends of the gap holding member 10 are inserted into the grooves 600 at both long sides which face each other in an opposed manner, and they are fixed thereto by frit glass or the like.

By fixing the gap holding members 10 using the inner frame 6 having such grooves 600, it is possible to easily erect the gap holding members 10 vertically (z direction); and, hence, a plurality of gap holding members 10 can be mounted at given positions without positional displacement. Mounting of the short sides (not shown in the drawing) is performed in the same manner, as will be explained later in conjunction with FIG. 7A and FIG. 7B.

Figure 7A:
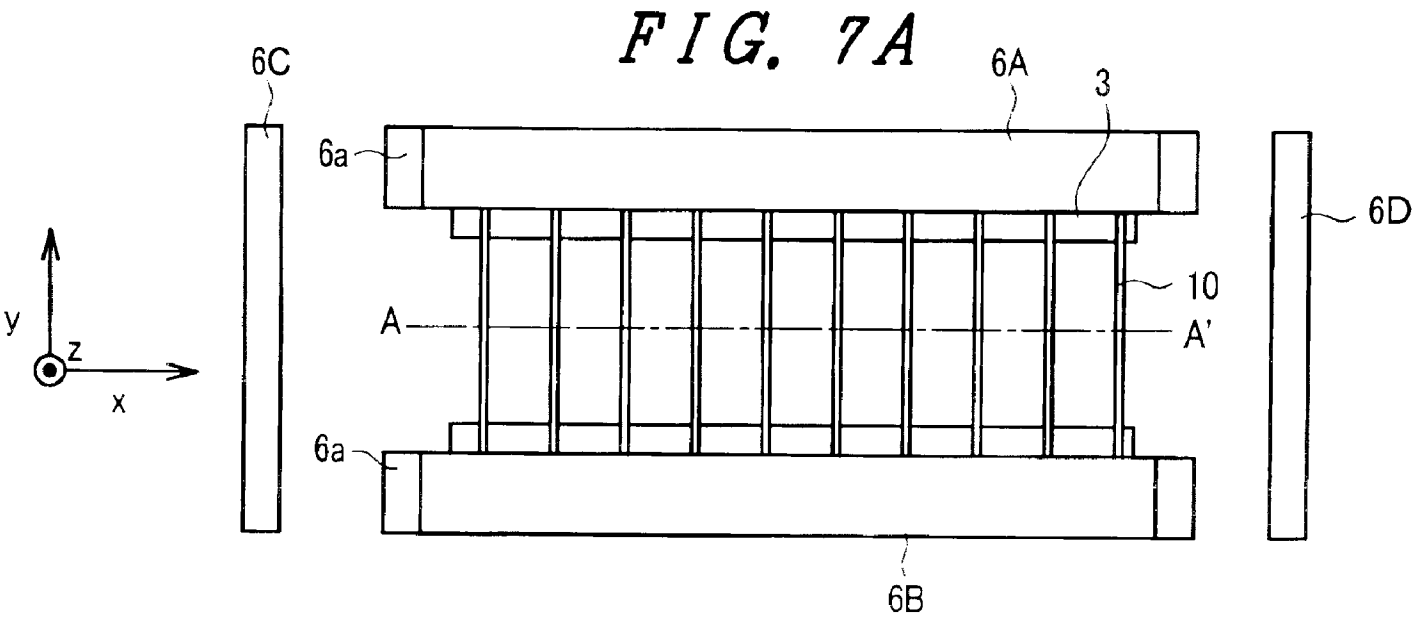
FIGS. 7A and 7B are plan and side views, respectively, showing an example of the inner frame.
Figure 7B:
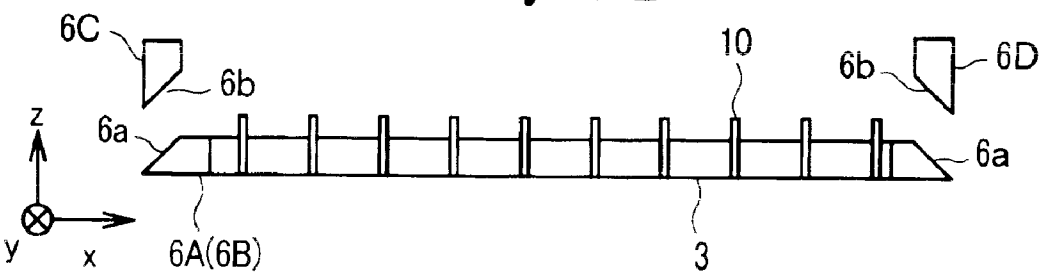

FIG. 7A and FIG. 7B are diagrams which show an example of the inner frame, including an example of the sides to which the gap holding members are mounted and a structure for fixing the above-mentioned sides with the short sides. FIG. 7A is a plan view and FIG. 7B is a side view. Although the gap holding member mounting sides 6A, 6B constitute long sides, similar to the long sides which have been described in conjunction with FIG. 6A and FIG. 6B, the grooves 600 shown in FIG. 6A and FIG. 6B are not formed. Symbols 6C, 6D indicate the short sides, and inclined faces 6*b*, which engage with end peripheries 6*a* of the long sides, are formed on end peripheries of the short sides. The gap holding members 10 are arranged between the long sides 6A, 6B, which were described in conjunction with FIG. 7A and FIG. 7B, using a jig. After fixing the gap holding members 10 to the long sides 6A, 6B using the frit glass 3, the inclined faces Ga of the long sides 6A, 6B are aligned with the inclined faces 6*b* of the short sides 6C, 6D by way of the frit glass (not shown in the drawing), and they are fixed to each other by pressing them from the z direction.

Figure 8:
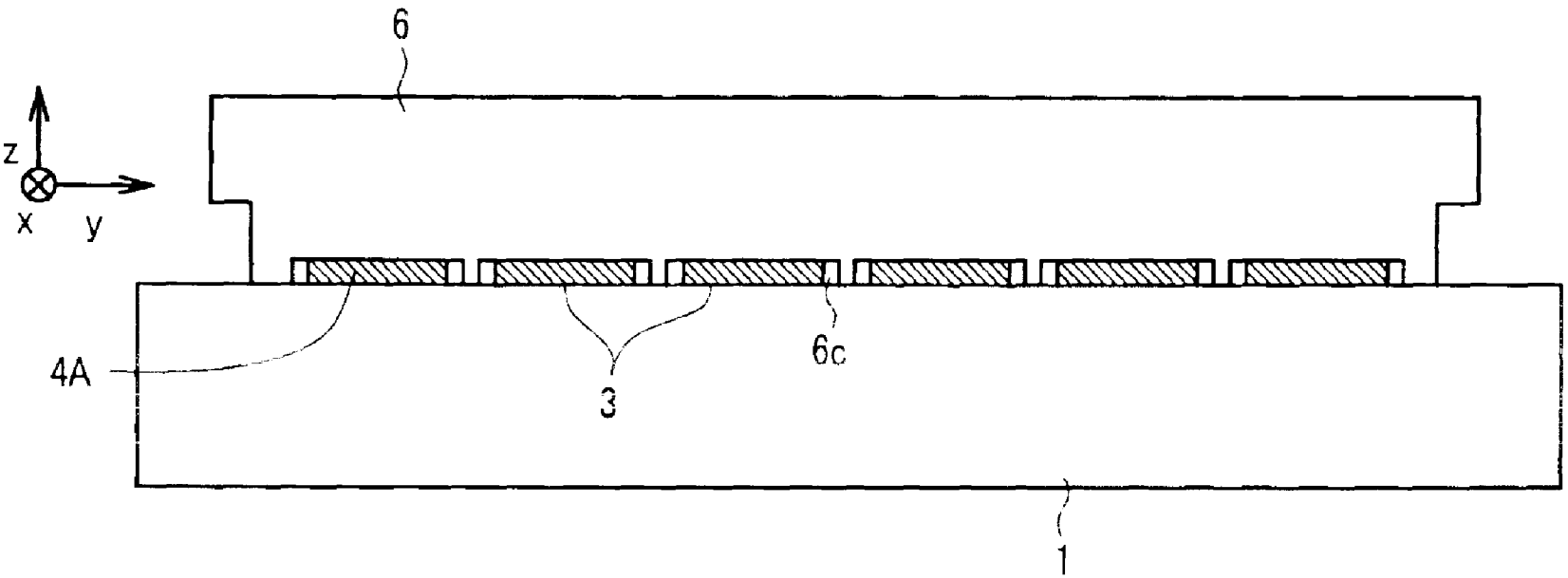
FIG. 8 is a cross-sectional view showing one example of the mounting structure of plate member control electrodes formed on a back substrate and the inner frame.

FIG. 8 is a cross-sectional view schematically showing one example of the mounting structure of the plate member control electrodes and an inner frame, which are formed on the back substrate. A plurality of strip-like electrode elements 4A, which constitute the plate member control electrodes, extend in the direction which is orthogonal to a paper surface and are arranged in parallel. In a side (bottom side) of the inner frame 6 at the back substrate 1 side, grooves 6*c* are formed, whose interval matches the pitch (pixel pitch) of the strip-like electrode elements 4A. The strip-like electrode elements 4A of the plate member control electrodes 4 are formed on the back substrate 1 and the strip-like electrode elements 4A are fixed by an adhesive, such as frit glass or the like, such that the strip-like electrode elements 4A are positioned in the grooves 6*c* that are formed in the inner frame 6. Due to such a constitution, the strip-like electrode elements 4A, which constitute the plate member control electrodes 4, are arranged at given positions at a given interval.

Figure 9:
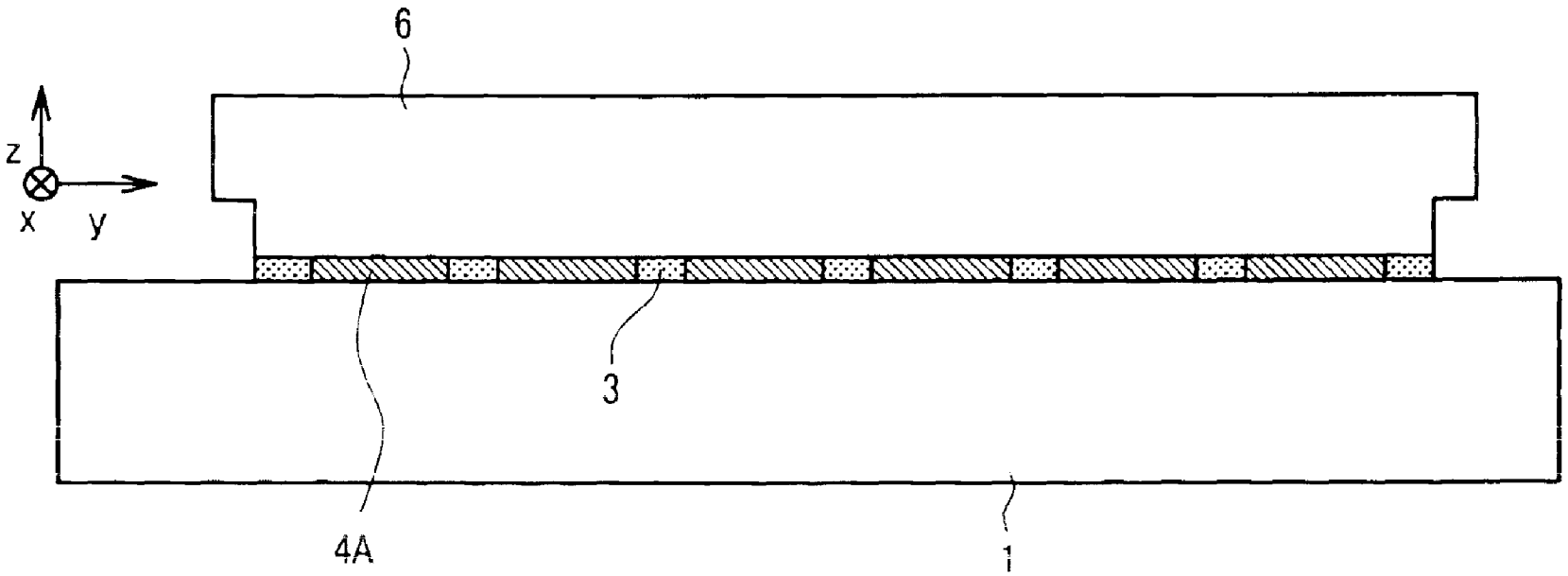
FIG. 9 is a cross-sectional view showing another example of the mounting structure of plate member control electrodes formed on the back substrate and the inner frame.

FIG. 9 is a cross-sectional view schematically showing another example of the mounting structure of the plate member control electrodes and an inner frame, which are formed on the back substrate. A plurality of strip-like electrode elements 4A, which constitute the plate member control electrodes, extend in a direction which is orthogonal to the paper surface and are arranged in parallel. In aside (bottom side) of an inner frame 6 at the back substrate 1 side, an adhesive 3, such as frit glass or the like, is provided at an interval which matches the pitch (pixel pitch) of the strip-like electrode elements 4A. The strip-like electrode elements 4A are mounted on the back substrate 1 at a given interval using a jig (not shown in the drawing), and they are fixed using the adhesive 3, such as frit glass. The inner frame 6 is mounted on the strip-like electrode elements 4A and is fixed to the back substrate 1 using the adhesive 3.

Figure 10A:
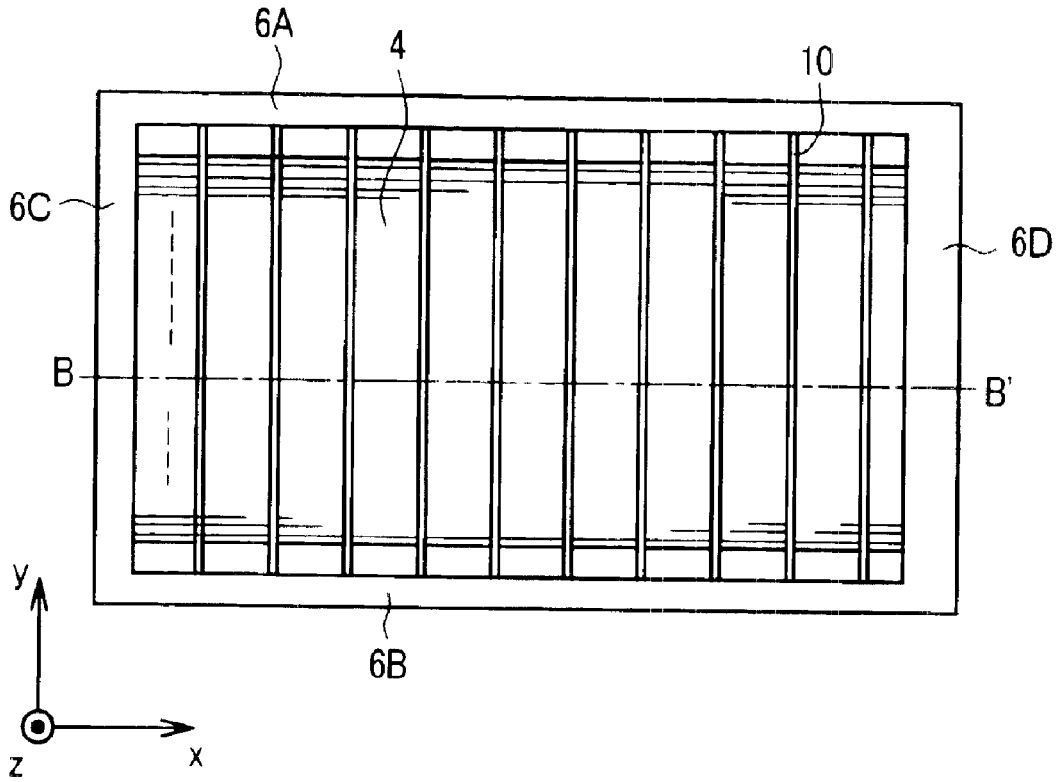
Figure 10B:
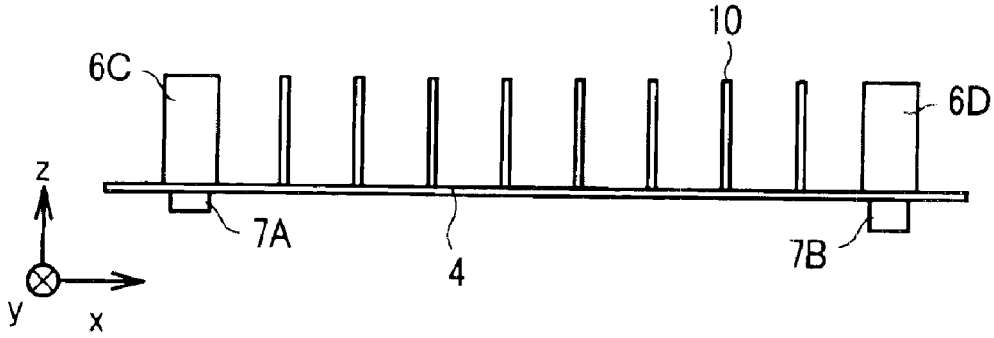

FIG. 10A and FIG. 10B are diagrams showing an example in which the inner frame, the plate member control electrodes and the gap holding members are integrally formed into one control electrode part. FIG. 10A is a plan view, and FIG. 10B is a cross-sectional view taken along a line B–B' in FIG. 10A. In this, the plate-member control electrodes 4 bridge short sides 6C, 6D of the inner frame 6, and support the gap holding members 10, and they are fixed to the short sides 6C, 6D by pressing plates 7A, 7B. This allows the inner frame, the plate member control electrodes and the gap holding members to be integrally formed into one part (control electrode part) and to be handled as one part. With such a constitution, the handling of the plate member control electrodes 4 in the assembling step is facilitated and the yield rate is also enhanced.

Figure 11:
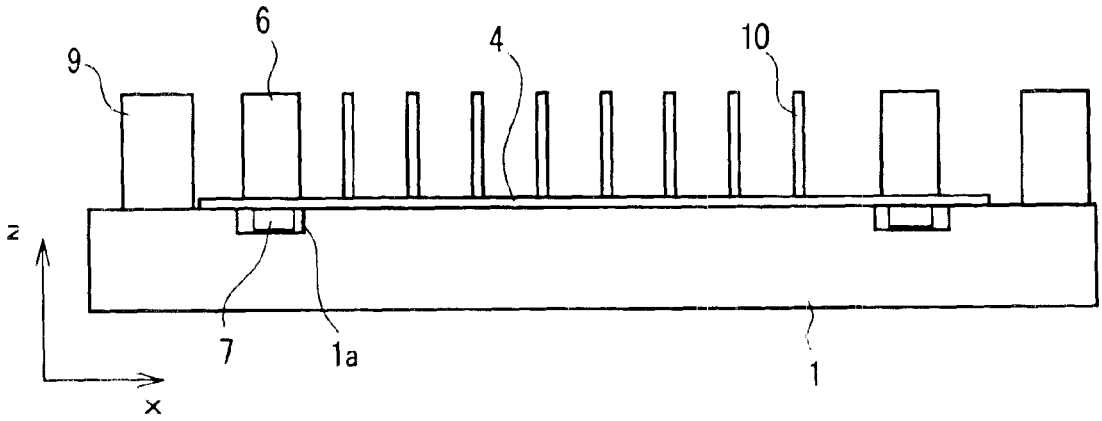
FIG. 11 is a cross-sectional view corresponding to a cross section taken along a line B—B' in FIG. 10A in which the control electrode part which is formed into a single part is mounted on the back substrate.

FIG. 11 is a cross-sectional view corresponding to a cross section taken along a line B–B' in FIG. 10A, which illustrates an example in which the control electrode part that is formed into one part, as described in conjunction with FIGS. 10A and 10B, is mounted on the back substrate. The pressing plates 7A, 7B, which were described in conjunction with FIG. 10A and FIG. 10B, are projected toward the back substrate 1 side. Grooves 1*a,* which accommodate the plate thickness of the pressing plates 7A, 7B, are formed in the back substrate 1. When the film thickness of the plate member control electrodes 4 is 0.05 mm, for example, the depth of the grooves la is set to approximately 0.075 mm by taking an adhesive, such as frit glass or the like, into account.

Figures 12A, 12B:
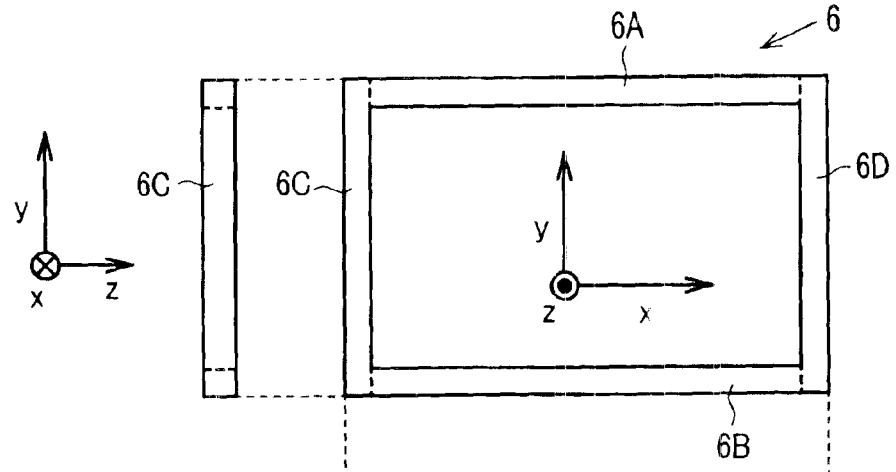
FIG. 12A, FIG. 12B and FIG. 12C are views corresponding to FIG. 3A, FIG. 3B and FIG. 3C, showing another example of the inner frame.
Figure 12C:
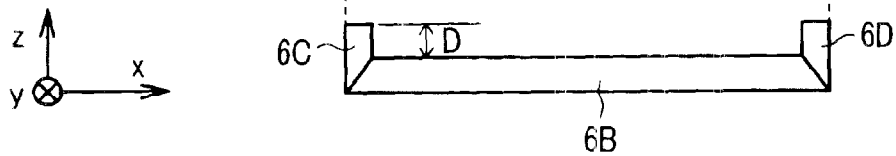

FIG. 12A, FIG. 12B and FIG. 12C are diagrams corresponding to FIG. 3A, FIG. 3B and FIG. 3C showing another example of the inner frame. The inner frame 6 is comprised of four sides consisting of a pair of short sides 6C, 6D, which fix the plate member control electrodes, and a pair of long sides 6A, 6B, which hold the short sides. End portions of the respective sides are provided with faces that are inclined faces in the z direction, that is, in the vertical direction. Respective inclined faces, which serve to form a frame shape, are brought into contact with each other and are fixed to each other using frit glass or the like. The height in the z direction of the short sides 6C, 6D has a difference in height D with respect to the height of the long sides 6A, 6B in the same manner as the example described in conjunction with the above-mentioned FIG. 3A, FIG. 3B and FIG. 3C.

Figure 13:
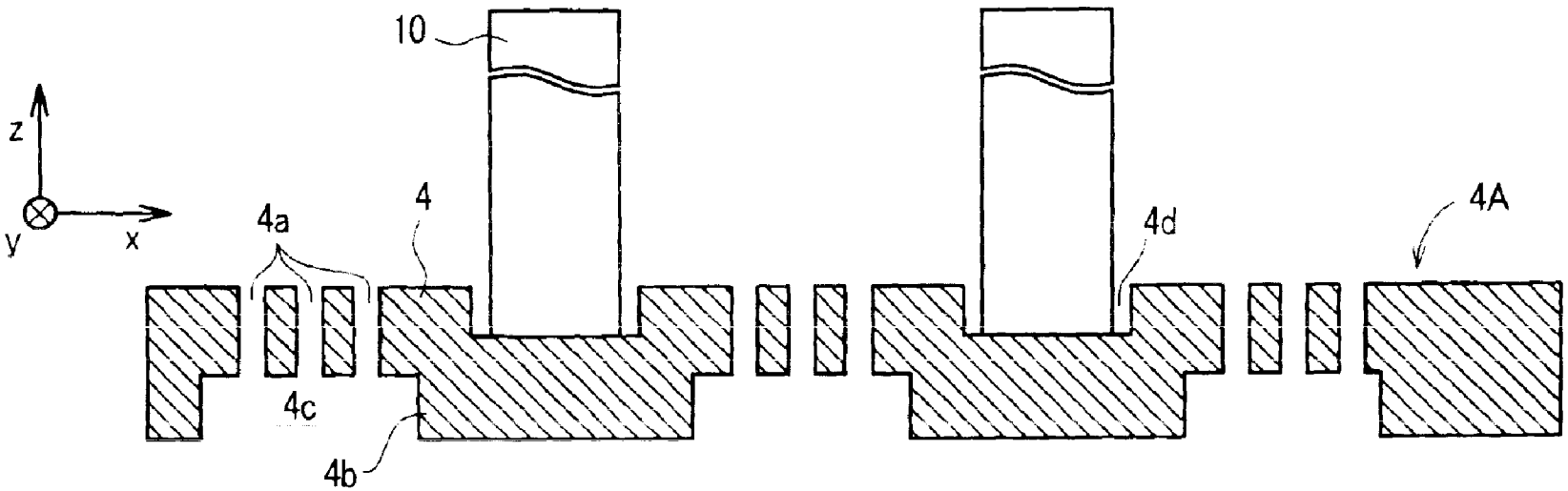
FIG. 13 is a cross-sectional view showing one example of the combined structure of the plate member control electrodes and the gap holding members.

FIG. 13 is a cross-sectional view showing one example of the combined structure of the plate member control electrodes 4 and the gap holding members 10. Grooves 4*d* are formed in the strip-like electrode elements 4A, which constitute the plate member control electrode 4, at a side thereof which faces the gap holding members 10. The strip-like electrode elements 4A include electron beam passing apertures 4*a,* and they are provided with recessed portions 4*c* at the back substrate side. The grooves 4*d* are formed together with the electron beam passing apertures 4*a* and the recessed portions 4*c* by etching or the like. Reference symbol 4*b* indicates leg portions which are brought into contact with the back substrate. By forming the grooves 4*d* in the strip-like electrode elements 4A, the alignment of the gap holding members 10 can be facilitated.

Figure 14:
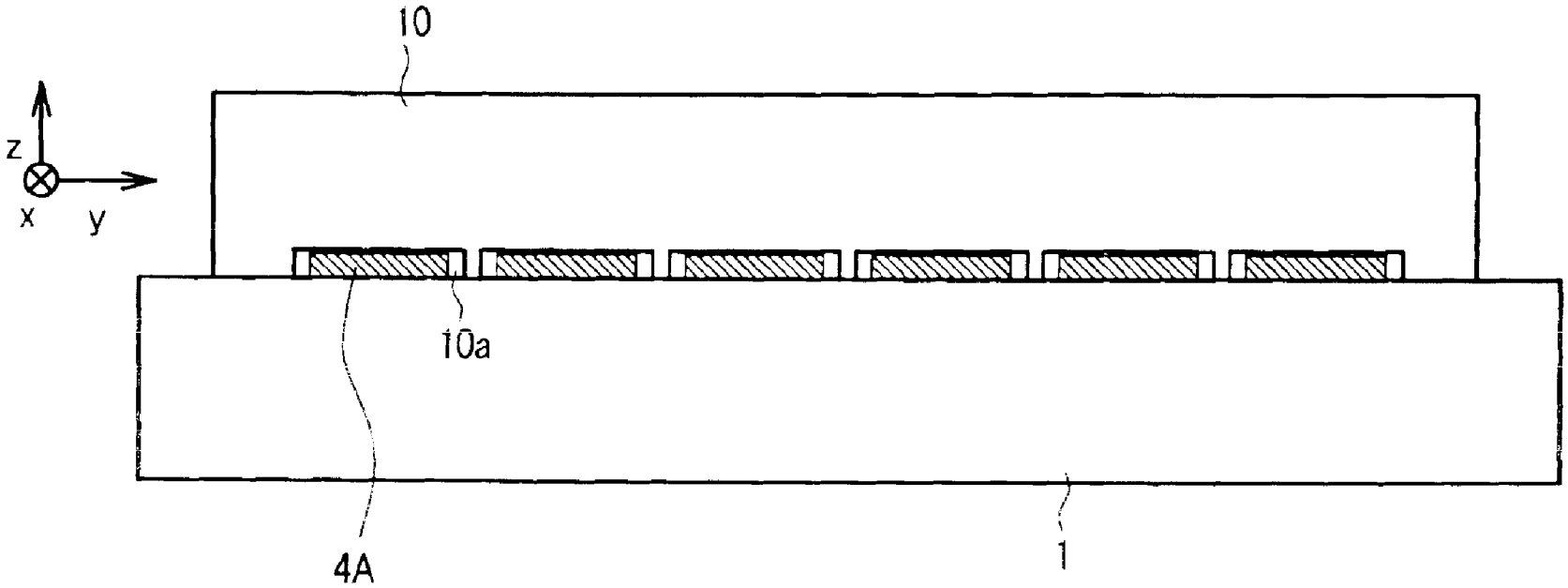
FIG. 14 is a cross-sectional view showing one example of the combined structure of the plate member control electrodes, the gap holding members and the back substrate.

FIG. 14 is a cross-sectional view showing one example of the combined structure of the plate member control electrodes, the gap holding members and the back substrate. In this example, grooves 10*a* are formed in portions (bottom side) at which the gap holding members 10 are brought into contact with the back substrate 1. The strip-like electrode elements 4A positioned inside of the grooves 10A. With such a constitution, there is no possibility that the strip-like electrode elements 4A will be excessively pressed by the gap holding members 10, so that the occurrence of cracks or breakage can be prevented.

Figure 15:
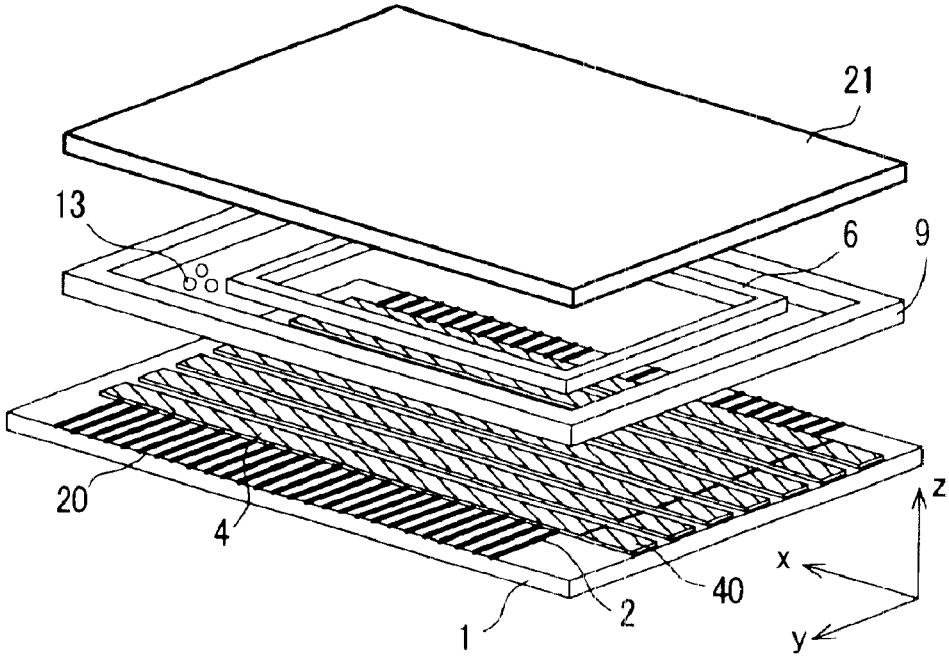
FIG. 15 is a developed perspective view showing the whole constitution of a display device of the present invention.

FIG. 15 is a developed perspective view showing the whole constitution of a display device of the present invention. Numeral 1 indicates a back substrate and numeral 21 indicates a front substrate. On an inner surface of the back substrate 1, a large number of cathode lines 2 are formed, which extend in a first direction (y direction) and are arranged in parallel in a second direction (x direction) which crosses the above-mentioned first direction. Electron sources, such as carbon nanotubes, are formed on cathode lines 2. Further, there are a plurality of plate member control electrodes 4 formed of a plurality of strip-like electrode elements, which extend in the second direction (x direction) which crosses the cathode lines 2 and are arranged in parallel in the above-mentioned first direction. Further, an anode and fluorescent materials are formed on the inner surface of the front substrate 21. The back substrate 1 and the front substrate 21 are sealed by the outer frame 9.

An inner frame 6 is provided inside the outer frame 9, and a getter chamber is formed between the outer frame 9 and the inner frame 6. Getters 13 are accommodated in the getter chamber. Video signals are supplied to the cathode lines 2 through cathode line lead lines 20. Control signals (scanning signals) are supplied to the plate member control electrodes 4 through control electrode lead terminals 40.

Figure 16:
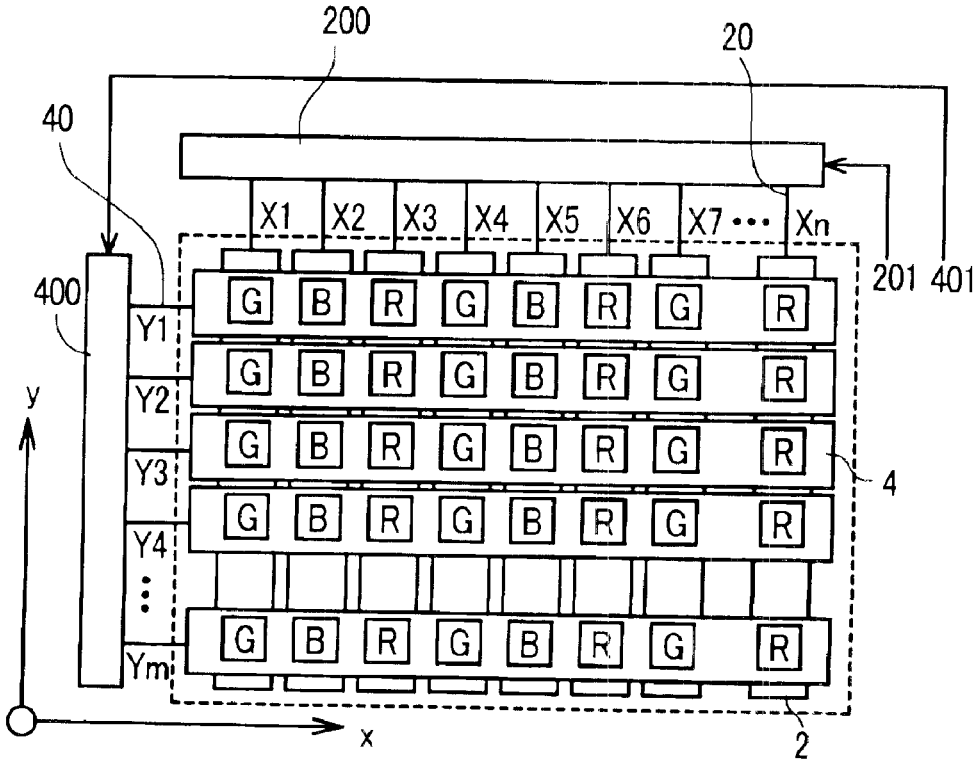
FIG. 16 is a diagram showing an example of an equivalent circuit of the display device of the present invention.
Figure 17:
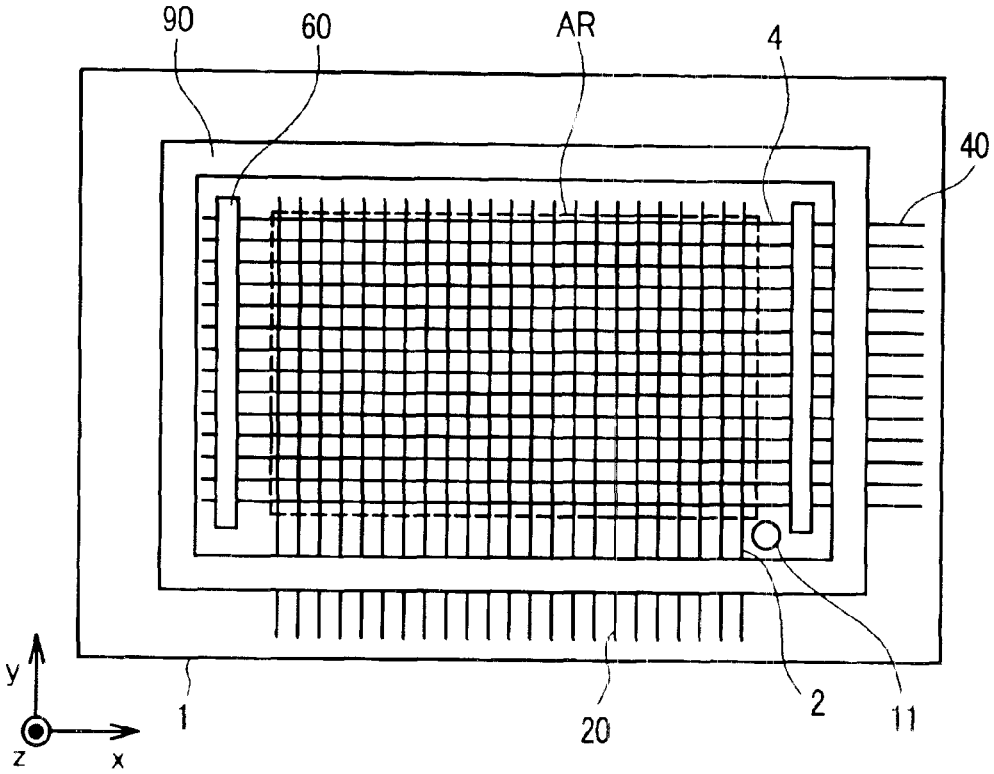
FIG. 17 is a plan view of the back substrate of a field emission type display device.
Figure 18:
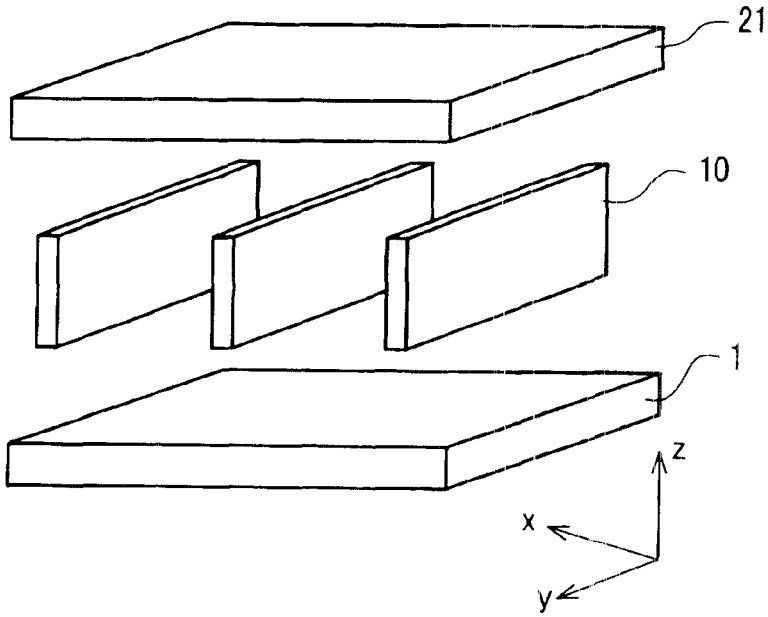
FIG. 18 is a perspective view showing one example of a mounting state of gap holding members which constitute means for maintaining a given gap between the back substrate and the front substrate.

FIG. 16 is an equivalent circuit diagram of the display device of the present invention. The region indicated by a broken line in the drawing indicates a display region. In the display region, the cathode lines 2 and the plate member control electrodes 4 (strip-like electrode elements 4A) are arranged to cross each other, thus forming a matrix of n x m lines. Respective crossing portions of the matrix constitute unit pixels, and one color pixel is constituted of a group of "R", "G", "B" unit pixels in the drawing. The cathode lines 2 are connected to a video drive circuit 200 through the cathode line lead lines 20 (X1, X2, . . . Xn), while the plate member control electrodes 4 are connected to a scanning drive circuit 400 through control electrode lead lines 40 (Yb, Y2, . . . Ym).

The video signals 201 are inputted to the video drive circuit 200 from an external signal source, while scanning signals (synchronous signals) 401 are inputted to the scanning drive circuit 400 in the same manner.

Accordingly, the given pixels which are sequentially selected by the strip-like electrode elements 4A and the cathode lines 2 are illuminated with lights of given colors so as to display a two-dimensional image. With the provision of a display device having such a construction, it is possible to realize a flat panel type display device which can be operated by a relatively low voltage and, hence, which exhibits high efficiency.

As has been explained heretofore, with the provision of the present invention, handling of the plate member control electrodes, which are constituted of a large number of parallel strip-like electrode elements, can be facilitated in the assembling step, the occurrence of cracks and breakage of the strip-like electrode elements can be reduced, and the operability and the yield rate of the products can be enhanced. Further, by forming the getter chamber between the outer frame and the inner frame and accommodating the getters in the getter chamber, it is also possible make the getters perform their function in the heat treatment in a sealing step if the display device so as to enhance the degree of vacuum, thus providing a highly reliable display device which can hold a given degree of vacuum for a long time.

What is claimed is:

1. A display device comprising:

a front substrate having an anode and fluorescent materials on an inner surface thereof;

a back substrate having a plurality of cathode lines, which extend in a first direction, are arranged in parallel in a second direction which crosses said first direction and include electron sources, and plate member control electrodes, which are formed by arranging a plurality of strip-like electrode elements, which cross the cathode lines in a non-contact state within a display region, extend in said second direction, are arranged in parallel in said first direction and have electron passing apertures which allow electrons from the electron sources to pass therethrough to the front substrate side, on an inner surface thereof, the back substrate being arranged to face the front substrate in an opposed manner with a given gap therebetween;

an outer frame for maintaining the given gap, which outer frame is interposed between the front substrate and the back substrate and surrounds the display region; and an inner frame which is arranged outside the display region and inside the outer frame and fixes both end regions of the strip-like electrode elements which constitute the plate member control electrodes to the back substrate.

2. A display device according to claim 1, wherein, with respect to the height of the outer frame and the height of the inner frame in a direction which is orthogonal to the surfaces of the front substrate and the back substrate, the height of at least one portion of the inner frame is set to be lower than the height of the outer frame.

3. A display device according to claim 1, wherein the inner frame is formed by integrally combining a plurality of members into a frame shape.

4. A display device according to claim 3, wherein the plurality of members which constitute the inner frame are constituted of a first pair of sides and a second pair of sides, and, at end portions of the first pair of sides and the second pair of sides, inclined surfaces which complementarily engage with each other in a direction orthogonal to the front substrate and the back substrate are formed.

5. A display device comprising:

a front substrate having an anode and fluorescent materials on an inner surface thereof;:

a back substrate having a plurality of cathode lines, which extend in a first direction, are arranged in parallel in a second direction which cross said first direction and include electron sources, and plate member control electrodes, which cross the cathode lines in a non-contact state within a display region, extend in said second direction, are arranged in parallel in said first direction and have electron passing apertures which allow electrons from the electron sources to pass therethrough to the front substrate side, on an inner surface thereof, the back substrate being arranged to face the front substrate in an opposed manner with a given gap therebetween;

an outer frame for maintaining the given gap, which outer frame is interposed between the front substrate and the back substrate and surrounds the display region;

an inner frame which is arranged outside the display region and inside the outer frame and fixes both end portions of the plate member control electrodes to the back substrate; and a plurality of gap holding members which are provided within the display region surrounded by the inner frame and maintain a gap defined between the front substrate and the back substrate.

6. A display device according to claim 5, wherein with respect to the height of the outer frame and the height of the inner frame in a direction which is orthogonal to the surfaces of the front substrate and the back substrate, the height of at least one portion of the inner frame is set to be lower than the height of the outer frame.

7. A display device according to claim 5, wherein grooves which engage with the plurality of gap holding members at given positions are formed on opposing surfaces of one pair of two parallel sides of the inner frame.

8. A display device according to claim 5, wherein the plurality of gap holding members are fixed to opposing faces of one pair of two parallel sides of the inner frame at the given positions using glass frit.

9. A display device according to claim 5, wherein grooves which serve to position the respective strip-like electrode elements of the plate member control electrodes are formed on sides of the inner frame which face the plate member control electrodes formed on the back substrate in an opposed manner.

10. A display device according to claim 5, wherein frit grass is used for fixing the respective strip-like electrode elements of the plate member control electrodes to given positions on sides of the inner frame which face the plate member control electrodes formed on the back substrate in an opposed manner.

11. A display device according to claim 5, wherein grooves which serve to position the respective strip-like electrode elements of the plate member control electrodes are formed on sides of the gap holding members which face the plate member control electrodes formed on the back substrate in an opposed manner.

12. A display device according to claim 5, wherein pressing plates which sandwich and fix the plate member control electrodes together with the inner frame are formed on the back substrate.

13. A display device according to claim 12, wherein grooves which accommodate the pressing plates are formed on the back substrate.

14. A display device comprising:

a front substrate having an anode and fluorescent materials on an inner surface thereof;

a back substrate having a plurality of cathode lines, which extend in a first direction, are arranged in parallel in a second direction which crosses said first direction and include electron sources, and a plurality of control electrodes, which cross the cathode lines in a non-contact state within a display region, extend in said second direction, are arranged in parallel in said first direction and allow electrons from the electron sources to pass therethrough to the front substrate side, on an inner surface thereof, the back substrate being arranged to face the front substrate in an opposed manner with a given gap therebetween;

an outer frame for maintaining the given gap, which outer frame is interposed between the front substrate and the back substrate and surrounds the display region;

an inner frame arranged outside the display region and inside the outer frame; and includes a getter chamber between the outer frame and the inner frame.

15. A display device according to claim 14, wherein members, which serve to suppress the movement of getters, are formed between the inner frame and the outer frame.

16. A display device according to claim 14, wherein an adhesive is provided to the getter chamber for fixing the getters.

17. A display device according to claim 14, wherein projection members, which serve to position the inner frame at a given position, are provided between the inner frame and the outer frame.

* * * * *